United States Patent [19]

Budzich

[11] Patent Number: 4,574,686

[45] Date of Patent: Mar. 11, 1986

[54] DIGITAL PROPORTIONAL SPOOL POSITION CONTROL OF COMPENSATED VALVES

[75] Inventor: Tadeusz Budzich, Moreland Hills, Ohio

[73] Assignee: Caterpillar Tractor Co., Peoria, Ill.

[21] Appl. No.: 637,348

[22] Filed: Aug. 6, 1984

Related U.S. Application Data

[63] Continuation of Ser. No. 319,764, Nov. 9, 1981, abandoned.

[51] Int. Cl.[4] ..... F15B 21/02

[52] U.S. Cl. ..... 91/35; 91/361; 91/459; 137/625.64; 137/625.65; 318/685

[58] Field of Search ..... 91/361, 363 A, 363 R, 91/418, 433, 444, 446, 459, 375 R, 384, 448; 137/625.63, 625.64, 625.65, 596.1; 318/685; 91/35

[56] References Cited

U.S. PATENT DOCUMENTS

| | | | |
|---|---|---|---|
| 2,420,693 | 5/1947 | White | 91/448 |
| 2,683,348 | 7/1954 | Petry | 91/374 |
| 3,644,817 | 2/1972 | Rosen | 318/696 |
| 3,677,298 | 7/1972 | Greenwood et al. | 137/625.64 |
| 4,095,421 | 6/1978 | Silcox | 251/131 |
| 4,107,923 | 8/1978 | Budzich | 91/446 |
| 4,190,081 | 2/1980 | Coles | 137/625.65 |
| 4,306,314 | 12/1981 | Griffiths | 251/131 |

*Primary Examiner*—Abraham Hershkovitz
*Attorney, Agent, or Firm*—J. W. Burrows

[57] ABSTRACT

A digital proportional valve with valve spool driven in discrete steps by a digital spool actuator in response to a remote manual control signal, while the proportional valve may be provided with positive and negative load compensation.

58 Claims, 8 Drawing Figures

DIGITAL PROPORTIONAL SPOOL POSITION CONTROL OF COMPENSATED VALVES

This is a continuation of Ser. No. 319,764, filed Nov. 9, 1981, now abandoned.

BACKGROUND OF THE INVENTION

This invention generally relates to remote control of a flow control valve, which provides valve spool displacement proportional to a remote manual control signal.

In more particular aspects this invention relates to a digital valve spool drive, which moves the valve spool in discrete steps, in response to a remote manually controlled digital signal.

In still more particular aspects this invention relates to a digital valve spool drive of a control valve, in which the pressure differential acting across the spool may be controlled by the positive and negative load compensators.

The great majority of electronic computing circuits, using micro-processors and computers, use a digital output signal. Digital valve spool drive, directly responding to such a signal, may be adapted to manual control. Such an adaptation presents a difficult problem, since not only the valve spool must be moved against considerable inertial, frictional and flow force resistance, but the valve spool travel must be proportional to the remote manual control signal, transmitted in digital form.

SUMMARY OF THE INVENTION

It is therefore a principal object of this invention to provide a remote control of a flow control valve, which provides valve spool displacement proportional to a remote manual control signal transmitted in digital form.

It is a further object of this invention to provide remote proportional control of a flow control valve responding to a digital control signal from a manually operated remote signal generator, the digital control signal being proportional to the manual input provided to the signal generator.

It is a further object of this invention to provide digital remote proportional control of spool position of a flow control valve, responding to a digital signal from a remote signal generator, such signal being proportional to the manual input and being transmitted electrically.

It is a further object of this invention to provide digital remote proportional control of spool position of a flow control valve, responding to a digital signal from a remote signal generator, such signal being proportional to the manual input and being transmitted by light pulses through fiber optics.

It is a further object of this invention to provide digital remote proportional control of spool position of a flow control valve, responding to a digital signal from a remote signal generator, such signal being proportional to the manual input and being transmitted by radio wave pulses from the radio wave transmitter.

It is a futher object of this invention to provide a digital valve spool actuator, which provides valve spool displacement proportional to a low energy level digital input signal, while the valve spool flow forces are reduced by positive and negative load compensation.

It is a further object of this invention to provide a digital valve spool actutor, which provides valve spool displacement proportional to a number of pulses of a low energy level digital input signal, while the flow from the valve is made proportional to the valve spool displacement by the positive and negative load compensation.

It is a further object of this invention to provide a digital valve spool actuator, in which a low energy linear digital input is hydraulically amplified and provided at a higher energy level to the valve spool.

Briefly, in the proportional valve control of this invention, a remote signal generator provides an output signal proportional to manual input, which is transmitted either electrically or through fiber optics or through radio waves to the digital valve spool actuator at a low energy level. The amplified digital digital electrical signal, either drives the digital actuator directly, in a series of linear steps, or provides the linear step input to the hydraulic amplifier, which amplifies the digital linear input and transmits it at a high energy level to the valve spool. The proportional valve to provide the proportional flow output and reduce the flow forces may have positive and negative load compensators.

Additional objects of this invention will become apparent when referring to the preferred embodiments of the invention as shown in the accompanying drawings and described in the following description.

DESCRIPTION OF THE PREFERRED EMBODIMENTS

Figure 1:
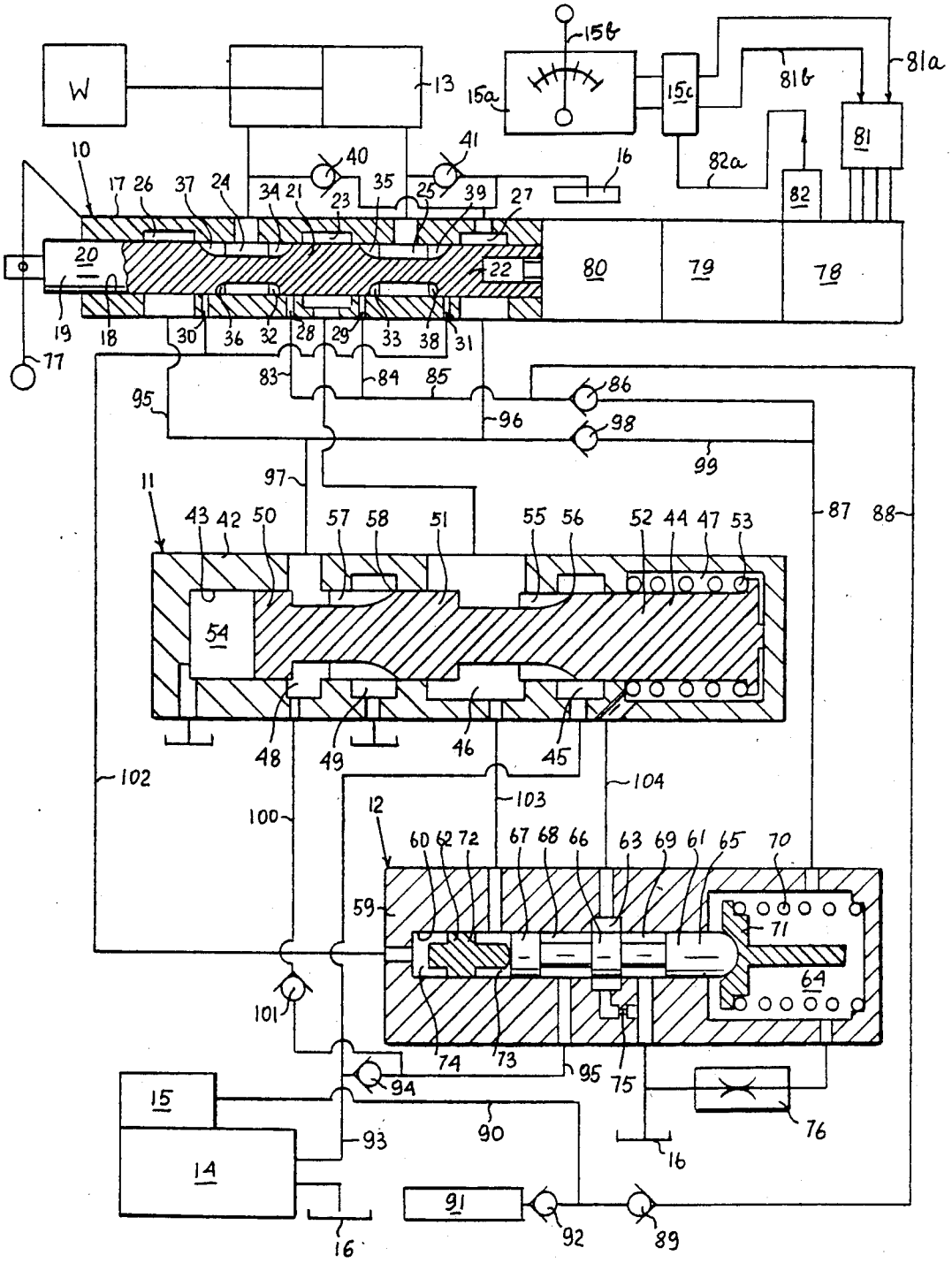
FIG. 1 is a longitudinal sectional view of an embodiment of a digital servo valve including control spool, positive and negative load compensator and pilot valve stage with manually controlled digital signal generator, digital spool actuator, amplifying stage, lost motion stage, lines, system flow control, system pump, second digital servo valve and system reservoir shown diagrammatically.

Referring now to FIG. 1, an embodiment of a flow control valve composed of a control valve section, generally designated as 10, a compensator section, generally designated as 11 and a pilot valve section, generally designated as 12, is shown interposed between diagrammatically shown fluid motor 13 driving a load W and a pump 14 of a fixed or variable type driven by a prime mover not shown.

If pump 14 is of a fixed displacement type, pump flow control 15 is a differential pressure relief valve, which in a well known manner, by bypassing fluid from the pump 14 to a reservoir 16, maintains discharge pressure of pump 14 at a level, higher by a constant pressure differential, than load pressure developed in fluid motor 13. If pump 14 is of a variable displacement type pump flow control 15 is a differential pressure compensator, well known in the art, which by changing displacement of pump 14 maintains discharge pressure of pump 14 at a level, higher by a constant pressure differential, than load pressure developed in fluid motor 13.

The flow control section 10 is a four way type and has a housing 17 provided with a bore 18 guiding a valve spool 19. Valve spool 19 is equipped with lands 20, 21 and 22 which, in neutral position of valve spool 19, as shown in FIG. 1, isolate a fluid supply chamber 23, load chambers 24 and 25 and outlet chambers 26 and 27. Positive load sensing ports 28 and 29 communicate with bore 18 and are positioned between the supply chamber 23 and load chambers 24 and 25. Negative load sensing ports 30 and 31 communicate with bore 18 and are positioned between load chambers 24 and 25 and outlet chambers 26 and 27. The land 21 is provided with signal slots 32 and 33 in plane of positive load sensing ports 28 and 29 and circumferentially spaced metering slots 34 and 35. The land 20 is provided with a signal slot 36 in plane of negative load sensing port 30 and circumferentially spaced metering slot 37. The land 22 is provided with a signal slot 38 in plane of negative load sensing port 31 and circumferentially spaced metering slot 39. Load chambers 24 and 25 are connected for one way fluid flow by check valves 40 and 41 with the reservoir 16.

The compensator section 11 has a housing 42 provided with a bore 43 slidably guiding a throttling spool 44. Bore 43 communicates with an inlet chamber 45, a supply chamber 46, a control chamber 47, an outlet chamber 48 and an exhaust chamber 49. The throttling spool 44 is provided with lands 50, 51 and 52 and biased, towards position as shown in FIG. 1, by a control spring 53. The land 50 of the throttling spool 44 defines space 54, which is connected to the reservoir 16. The land 52 of the throttling spool 44 is provided with positive load throttling slots 55, terminating in throttling edges 56 and positioned between the inlet chamber 45 and the supply chamber 46. The land 51 of the throttling spool 44 is provided with negative load throttling slots 57, terminating in throttling edges 58 and positioned between the outlet chamber 48 and the exhaust chamber 49.

The pilot valve section 12 comprises a housing 59 provided with a bore 60, slidably guiding a pilot spool 61 and a free floating piston 62, annular space 63 and control space 64. The pilot valve spool 61 has lands 65, 66, and 67, defining annular spaces 68 and 69. The land 65 projects into control space 64 and is biased by a pilot valve spring 70, through a spring retainer 71. The land 67 is selectively engageable by the free floating piston 62, provided with a land 72, which defines spaces 73 and 74. Annular space 63 is connected with annular space 69 by a leakage orifice 75. Control space 64 is connected with annular space 69 and the reservoir 16 by a leakage flow section 76.

Valve spool 19, of control valve section 10, is provided with manual input through manual input lever 77. The valve spool 19 is also provided with a digital control input from a stepper motor 78, through a hydraulic force amplifier 79 and a lost motion mechanism 80. The digital input signal is supplied to the stepper motor 78 from a solid state switch 81, while a transducer 82 supplies a feedback signal to a control circuit.

The digital input signal is generated by a signal generator **15*a* which provides low energy digital output signal proportional to the displacement of control lever 15*b* and signal generating mechanism 15*d* from their neutral position. This output signal is transmitted through signal storage device 15*c* and lines 81*a* and 81*b* to the solid state switch 81. The signal storage device 15*c* is also connected by line 82*a* with digital feedback transducer 82. Assume that line 81*a* transmits a digital signal to the solid state switch 81. Then in a manner, as will be described when referring to FIGS. 5, 6 and 7, line 81*b* transmits a control signal which determines the direction of rotation of the stepper motor 78**.

Positive load sensing ports 28 and 29, of the control valve section 10, are connected through lines 83, 84 and 85, check valve 86 and line 87 to control space 64. Positive load sensing ports 28 and 29 are also connected through line 88, check valve 89 and line 90 to the pump flow control 15, which also receives a control signal from control circuit 91 through a check valve 92. The output flow from the pump 14 is connected by discharge line 93 to the inlet chamber 45, while also being connected through check valve 94 and line 95 to annular space 68. Outlet chambers 26 and 27 are connected by lines 95, 96 and 97 with the outlet chambers 48, while also being connected through check valve 98 and lines 99 and 87 to control space 64. The outlet chamber 48 is connected by line 100 and check valve 101 to line 95. Negative load sensing ports 30 and 31 are connected through line 102 with space 74 in the pilot valve section 12. The supply chamber 46 is connected by line 103 with space 73. The control chamber 47 is connected by line 104 with annular space 63.

Figure 2:
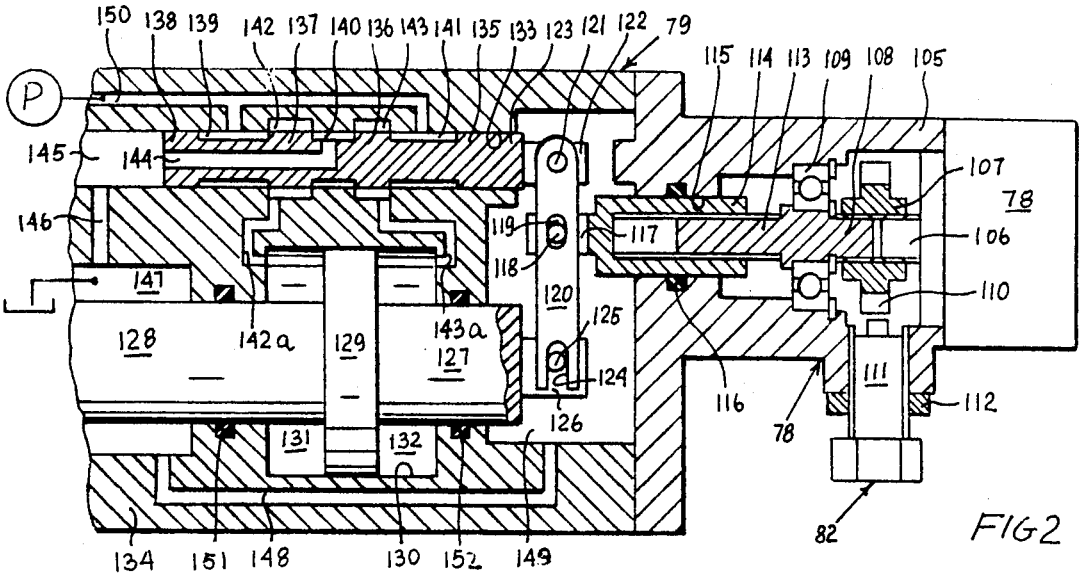
FIG. 2 is a partial longitudinal sectional view of an embodiment of a spool drive provided with a hydraulic amplifying stage, the digital actuator being shown schematically.

Referring now to FIG. 2, the stepper motor 78 of FIG. 1, a portion of the housing of which is shown as **78*a*, is mounted on a cover 105 and engages, with its splined shaft 106, a coupling 107, which in turn engages the splined extension of rotary shaft 108, which is journalled by a bearing 109. The coupling 107 is provided with a gear section 110, radially spaced from a pulse pick-up 111, threaded in the cover 105 and retained by a lock nut 112. A threaded end 113 of the rotary shaft 108 engages the internal threads of an input sleeve 114, which is slidably guided in bore 115 provided in the cover 105 and suitably sealed by a seal 116. The input sleeve 114, with its slotted end 117 and pin 118, engages slot 119, provided in a servo link 120. The servo link 120, mounted by a pin 121 on a slotted end 122 of a pilot valve 123, engages with slot 124, a pin 125, located on extension 126 of cylindrical end 127 of an actuator 128. The actuator 128 is also provided with a piston 129, slidably engaging cylindrical surface 130 and defining spaces 131 and 132. The pilot valve 123, slidably mounted in bore 133, provided in a housing 134, has hands 135, 136, 137 and 138 defining annular spaces 139, 140 and 141. The lands 136 and 137 work in metering engagement with annular spaces 142 and 143. Annular space 142 is connected by passage 142*a* with space 131. Annular space 143 is connected by passage 143*a* with space 132. Annular space 140 is connected by passage 144, space 145, passage 146 and space 147 to schematically shown system reservoir. Space 147 is also connected by passage 148 to space 149 housing the servo link 120. Annular spaces 139 and 141 are connected by passage 150 with the schematically shown system pump 14. Cylindrical ends of the actuator 128 are suitably sealed by seals 151 and 152**.

Figure 3:
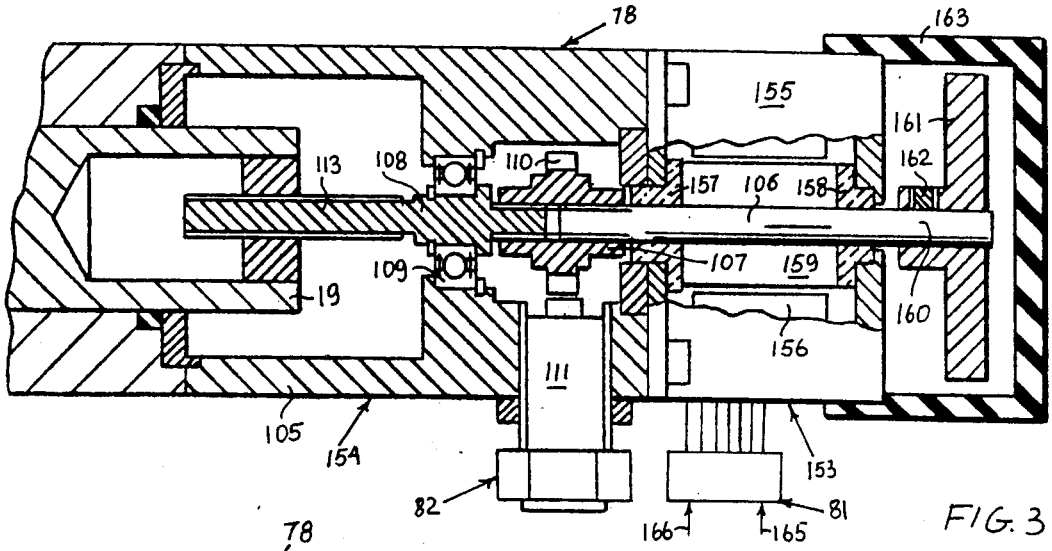
FIG. 3 is a partial longitudinal sectional view of one embodiment of digital spool drive.

Referring now to FIG. 3, like components of FIGS. 1 and 2 are designated by the same numerals. The digital actuator 78 is composed of a stepper motor, generally designated as 153 and lead screw mechanism, generally designated as 154. The stepper motor 153 is provided with a housing 155, locating a stator winding 156 and bearings 157 and 158. Bearings 157 and 158 journal the shaft 106 with a rotor 159. The shaft 106 engages, through its splined end, the coupling 107, which in turn engages threaded end of the rotary shaft 113. The rotary shaft 108, mounted in respect to the housing 105 by the bearing 109, engages with its threaded end 113 the valve spool 19. The shaft 106 is provided with an extension 160 protruding outside of the housing 155 of the stepper motor 153, to which a hand wheel 161 is suitably fastened by a lock screw 162. The hand wheel 161 is suitably protected by a guard 163, engaging the housing 155 of the stepper motor 153. The energy to the digital actuator 78 and specifically to the stepper motor 153 is supplied through suitable wiring from a driver or solid state switch 81, which is subjected to a pulse control input 165 and a direction of rotation control input 166.

Figure 4:
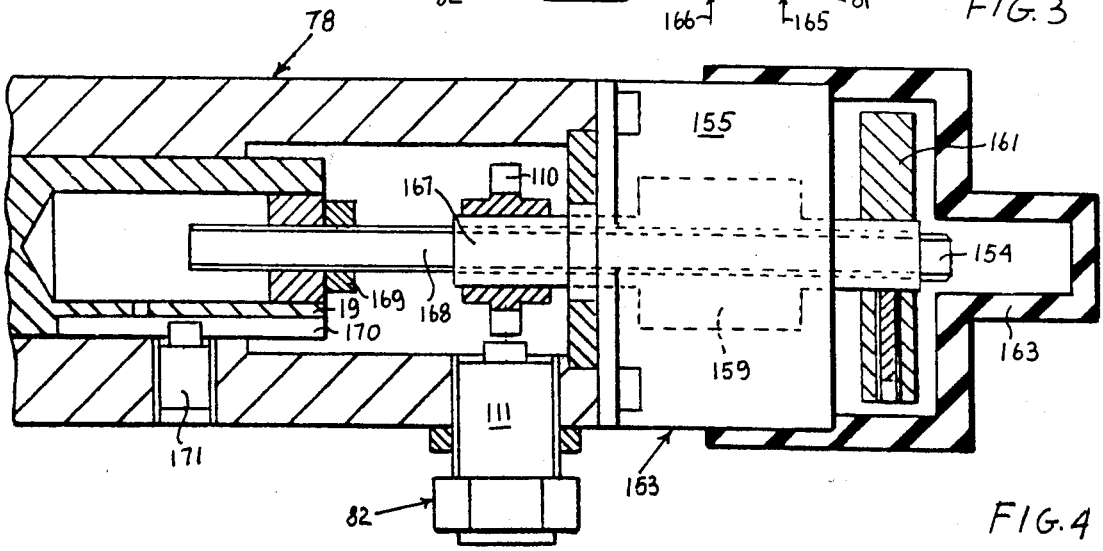
FIG. 4 is a partial longitudinal sectional view of another embodiment of digital spool drive.

Referring now to FIG. 4, which is very similar to FIG. 3, like components are denoted by the same numerals. An enlarged shaft 167 of the rotor 159 is suitably mounted in the bearings not shown, of the housing 155 of the stepper motor 153 and protrudes on both sides of the stepper motor 153. One end of the enlarged shaft 167 carries the hand wheel 161, while the other end carries the gear section 110. The enlarged shaft 167 is internally threaded and engages a threaded shaft 168, which in turn engages the internal threads of the valve spool 19 and lock nut 169. The valve spool 19 is prevented from rotation with slot 170, engaging antirotational pin 171.

Figure 5:
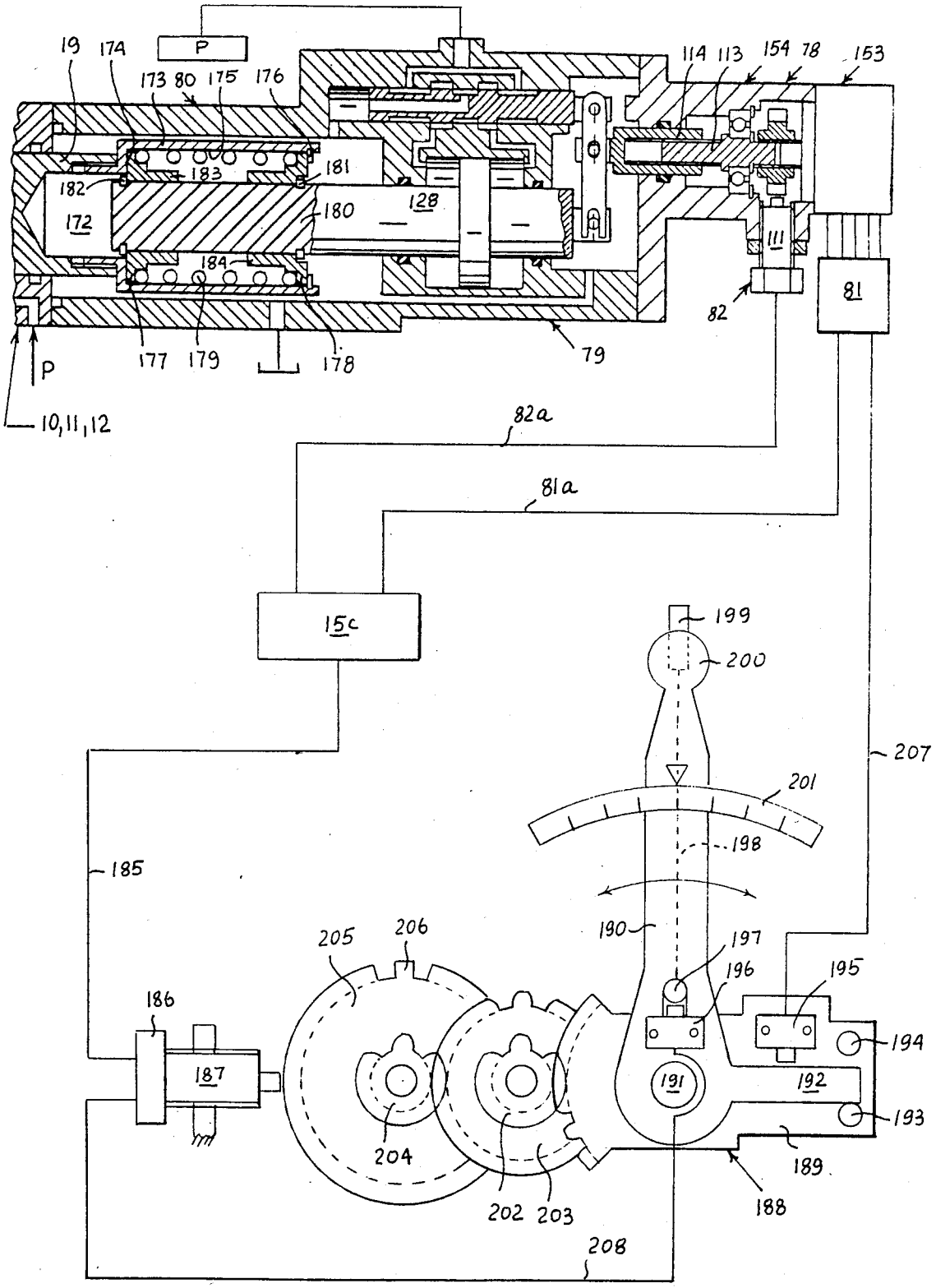
FIG. 5 is a partial longitudinal sectional view of spool drive of FIG. 2 including rotary to linear digital drive and lost motion mechanism with manually controlled remote digital electrical signal generator, the digital motor and other control system components shown diagrammatically.

Referring now to FIG. 5, like components of FIGS. 1 and 2 are designated by the same numerals. The digital actuator 78, composed of the stepper motor 153 and the lead screw mechanism 154, together with the hydraulic force amplifier 79, are identical to those shown and described in detail when referring to FIG. 2. The actuator 128 is connected to the lost motion mechanism 80. The lost motion mechanism is shown in section. The end of the valve spool 19 is provided with a bore 172, mounting threaded sleeve 173, provided with stop 174, internal cylindrical surface 175 and retaining ring 176. Internal cylindrical surface 175 guides reaction members 177 and 178, which are maintained by biasing force of a spring 179 against stop 174 and the retaining ring 176. A shaft 180 of the actuator 128 is located in position in respect to the sleeve 173 by retaining rings 181 and 182 engaging reaction members 177 and 178. Reaction members 177 and 178 are provided with cylindrical extensions 183 and 184 guided on the surface of the shaft 180. The digital actuator 78 is provided with rotary motion from the stepper motor 153, which is connected to lead screw mechanism 154. The electrical pulses to the stepper motor 153 are transmitted from solid state switch 81, which is connected by line **81*a* to the signal storage device 15*c*. The signal storage device 15*c* also receives a signal through line 82*a* from the transducer 82, having the pulse pick-up 111 and also receives a pulse signal through line 185 from a transducer 186, provided with a pulse pick-up 187. A manually operated pulse generator, generally designated as 188, is provided with a gear sector 189 mounting a manual lever 190 around pivot 191. The manual lever 190 is provided with an extension 192, which selectively engages pins 193 and 194, mounted on the gear sector 189 and permitting the manual lever 190 limited freedom of rotation in respect to the gear sector 189. The extension 192 selectively engages reverse switch 195 mounted on the gear sector 189. The switch 196 is mounted on the manual lever 190 and is actuated by pin 197 mechanically connected by connecting mechanism 198, shown in dotted line, to the on-off button 199, guided in the spherical extension 200 of the manual lever 190. The manual lever 190 moves in respect to quadrant 201, which shows its angular inclination. The gear sector 189, journalled around pivot 191 engages with its teeth a spur gear 202 mounted on a concentrically located spur gear 203, which in turn engages a spur gear 204 concentrically mounted on a pulse disc 205, provided with teeth 206. The reverse switch 195 is connected by line 207 with the solid state switch 81. The switch 196 is connected by line 208 to the transducer 186**.

Figures 6, 7:
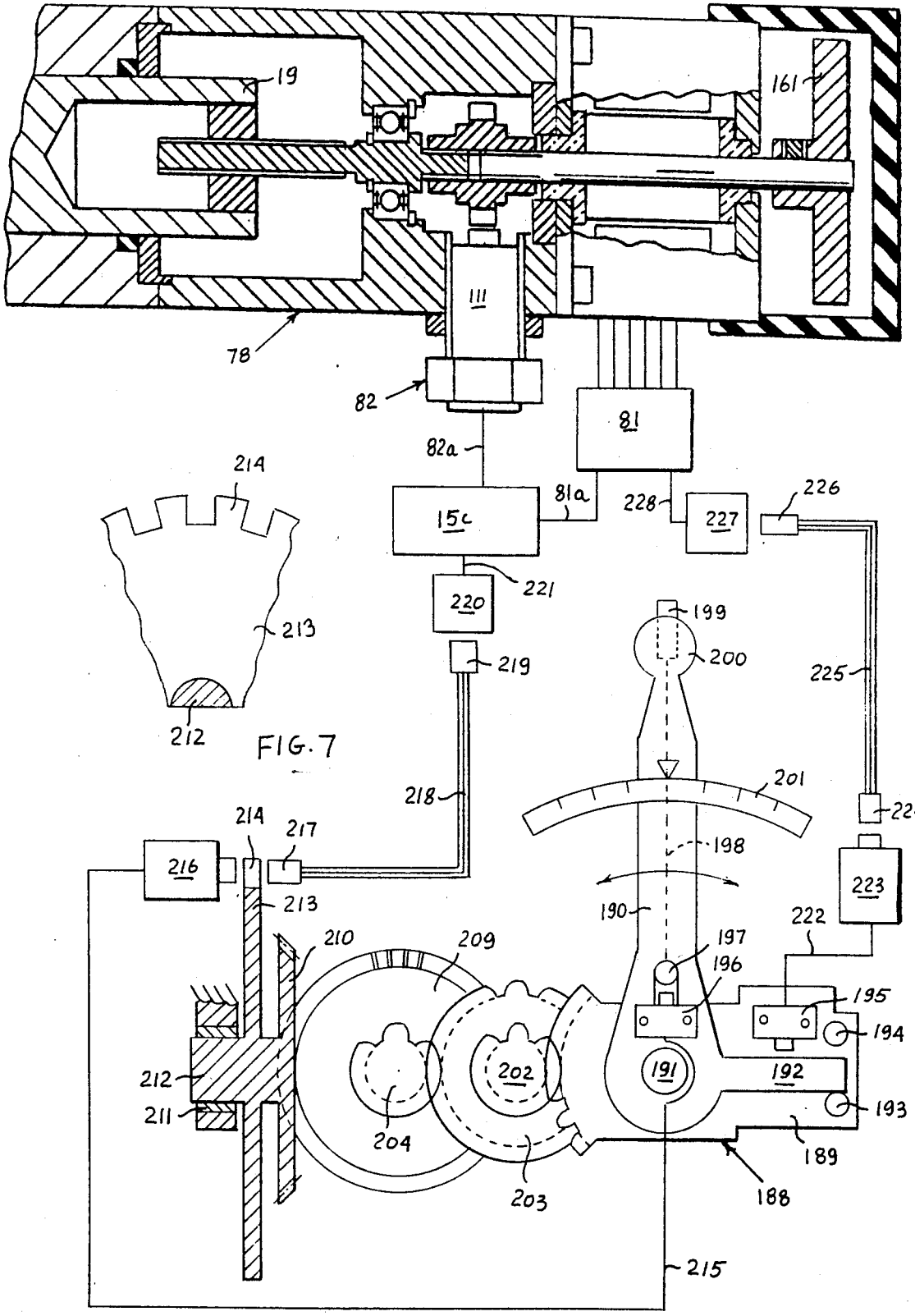
FIG. 6 is a partial longitudinal sectional view of spool drive of FIG. 3 with manually controlled remote digital signal generator based on the principle of fiber optics shown diagrammatically.
FIG. 7 is a partial end view of the disc of FIG. 6.

Referring now to FIG. 6, like components of FIGS. 3 and 5 are designated by the same numerals. The digital actuator 78, identical to that of FIG. 3, is supplied with a digital control signal from the manually operated pulse generator 188, indentical to that shown in FIG. 5, with the pulse disc 205 driven by the spur gear 204 of FIG. 5 being substituted in FIG. 6 by a bevel gear 209, drivingly engaging bevel gear 210 journalled in a bearing 211 by a shaft 212, to which a disc 213 is attached. The disc 213 is perforated on its periphery and provided with segments 214, see FIG. 7, which shows a partial end view of the disc 213. The switch 196 is connected by line 215 to a source of light 216, which is positioned directly in front of the transparent fitting 217 of glass fiber strands 218, which terminate in transparent fitting 219. The perforations and the segments 214 of the disc 213 are interposed between the light source 216 and the transparent fitting 217. The transparent fitting 219 is positioned in front of photo-electric cell or light sensing diode 220, connected by line 221 to the signal storage device **15*c*. The reverse switch 195 is connected by line 222 to a source of light 223, positioned opposite a transparent fitting 224, of glass fiber strands 225, also provided with a transparent fitting 226. The transparent fitting 226 is positioned opposite a photo-electric cell or light sensing diode 227, connected by line 228 with the solid state switch 81**.

Figure 8:
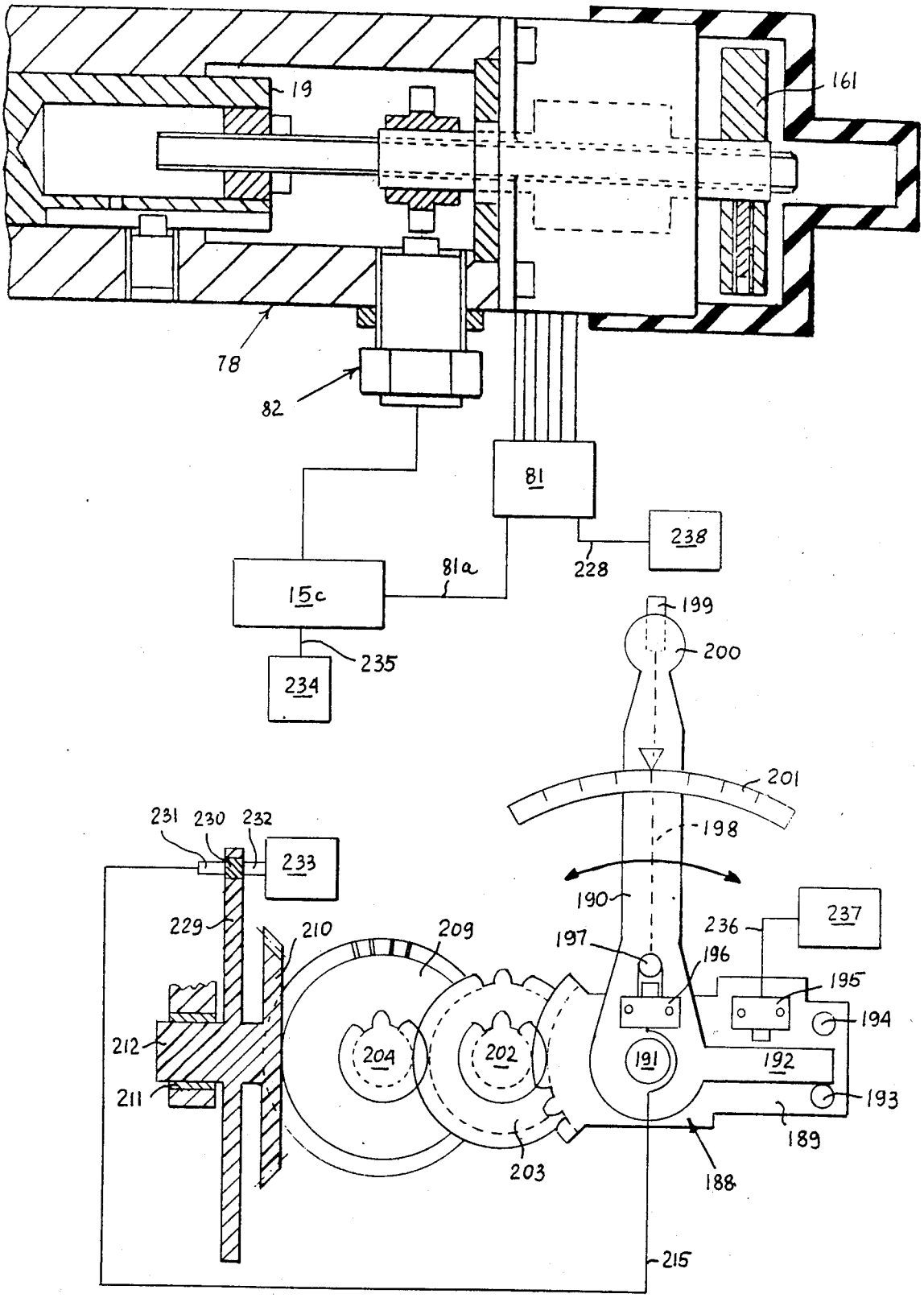
FIG. 8 is a partial longitudinal sectional view of spool drive of FIG. 4 with manually controlled remote digital signal generator based on the principle of radio wave transmitter shown diagrammatically.

Referring now to FIG. 8, like components of FIGS. 4, 5 and 6 are designated by the same numerals. The digital actuator 78, identical to that of FIG. 4, is supplied with a digital control signal from the manually controlled pulse generator 188, identical to that of FIG. 6. The disc 213 of FIG. 6 with its segments 214 is substituted by disc 229 provided with current conducting discs 230, uniformally spaced adjacent to its periphery and working in sliding engagement with its contacts 231 and 232. The contact 231 is connected by line 215 with the switch 196. The contact 232 is directly connected to radio wave transmitter 233, operating say on X frequency. The radio waves at X frequency are picked up by a receiver 234, which transmits electrical pulses through line 235 to the signal storage device **15*c*. The reverse switch 195 is connected by line 236 with a radio transmitter 237, operating, say on Y frequency. The radio waves at Y frequency are picked up by a receiver 238, which transmits reverse direction signal in the form of a steady voltage through line 228 to the solid state switch 81**.

Referring now to FIG. 1, the digital proportional valve assembly is shown composed of three separate and distinct sections and that is the control valve section 10, the compensator section 11 and a pilot valve section 12. Although those sections, for better purposes of demonstration, are shown separated, actually they are combined into a single valve assembly.

In general terms the control valve section 10 controls the direction of fluid flow to and from the fluid motor 13, selectively phasing its working chambers to the pump or to the system reservoir, which chamber is being pressurized depending on the polarity of the load W. The control valve section 10 provides variable area orifices leading to and from the fluid motor 13, the area of those orifices being controlled by the displacement of the valve spool 19 from its neutral position. The variable orifices leading to the fluid motor 13 and used in control of positive loads are created by displacement of metering slots 34 and 35. The variable orifices leading from the fluid motor and used in control of negative loads are created by displacement of metering slots 37 and 39. The valve spool 19 can be manually operated by the manual input lever 77, or its position can be controlled by the digital actuator 78, through the hydraulic force amplifier 79 and the lost motion mechanism 80. The electrical energy to the digital actuator 78 is supplied from a driver, or a logic chip, or a solid state switch 81. The solid state switch 81 receives from manual signal generator 15*a* through line 81*a* a digital input signal, the number of pulses of which are proportional to the displacement of the control lever 15*b* from its neutral position. Each pulse at low energy level triggers the solid state switch 81 and results in a specific angular displacement of the stepper motor 78. Therefore displacement of the valve spool 19, due to the action of the hydraulic force amplifier 79, will be proportional to the displacement of the control lever 15*b* from its neutral position. The solid state switch 81 also receives from the manual signal generator 15*a* another steady voltage control signal through line 81*b*, which determines by the voltage level the direction of rotation of the stepper motor 78 and therefore the direction of the linear steps transmitted to the valve spool 19. The digital transducer 82 senses the number of linear steps and transmits a digital feedback signal through line 82*a* to the signal storage device 15*c*. The signal storage device 15*c* automatically compares the number of steps made by the digital actuator with the number of pulses supplied from the signal generator 15*a* and sends an error signal through line 81*a*. In this way if the stepper motor 78 cannot follow fast enough the number of pulses per unit time supplied from the signal generator, due to the action of the digital feedback signal and the signal storage device 15*c* the stepper motor will end up with the correct number of steps. While the position of the valve spool 19 is being controlled by the digital actuator 78, through the hydraulic force amplifier 79, the control spool 19 can be fully displaced in either direction by the manual input lever 77, overriding the positioning action, when the operator assumes the control. This feature is made possible by the lost motion mechanism 80, operation of which will be described later in the specification when referring to FIG. 5.

The pressure differential across the variable control orifices of the control valve section 10, interposed between the pump 14, the fluid motor 13 and the reservoir 16, during control of both positive and negative loads is controlled by throttling by the throttling spool 44 of the compensator section 11. While the positive load is being controlled the throttling edges 56, of positive load throttling slots 55, assume a position to sufficiently throttle the fluid flow from the system pump to maintain a constant pressure differential across metering slots 34 or 35. With constant pressure differential automatically maintained across the metering slots 34 or 35 the fluid flow into the fluid motor, during control of positive load, becomes proportional to the displacement of the valve spool 19 from its neutral position and independent of the magnitude of the positive load W. With negative load being controlled, the throttling edges 58 of the negative load throttling slots 57 assume a position to sufficiently throttle the outlet fluid flow from the fluid motor 13, to maintain a constant pressure differential across metering slot 37 or 39. With constant pressure differential, automatically maintained across metering slots 37 or 39, the flow out of the fluid motor 13, during control of negative load, becomes proportional to the displacement of the valve spool 19 from its neutral position and independent of the magnitude of the negative load W. During control of positive load positive load throttling slots 55 are always positioned upstream of the metering slots 34 and 35, while during control of negative load negative load throttling slots 57 are always positioned down stream of metering slots 37 and 39. The position of the throttling spool 44 is determined by the control pressure in the control chamber 47, against the biasing force of the control spring 53.

The pressure in the control chamber 47 of the throttling section 11 and therefore the amount of throttling of the pump pressure or the negative load pressure is controlled by the pilot valve assembly 12. During control of positive load the pilot spool 61 is subjected on one end to the positive load pressure in control space 64, transmitted from positive load sensing port 28 or 29 through line 83 or 84, line 85, check valve 86 and line 87, together with the biasing force of the pilot valve spring 70, while at the other end through line 103 it is subjected to pressure in the supply chamber 46, which is positioned down stream of positive load throttling slots 55. Subjected to those forces the pilot valve spool 61 assumes a modulating position, in which it controls the pressure in the control chamber 47, to sufficiently throttle the fluid flow from the inlet chamber 45, to maintain a constant pressure differential across metering slot 34 or 35. While controlling a positive load the free floating piston 62 is maintained by the pressure differential maintained across it all the way to the left, out of contact with the pilot valve spool 61. During of control of negative load the pilot valve spool 61 is subjected on one end to the pressure in control space 64, which is connected by lines 87 and 99, check valve 98 and lines 95 and 96 to the outlet chambers 26 and 27, down stream of metering orifice 37 or 39, together with the biasing force of the pilot valve spring 70, hile the other end of the pilot valve spool 61, through the free floating piston 62, is subjected to pressure in negative load sensing port 30 or 31 connected to space 74 by line 102. Subjected to those forces the pilot valve spool 61 assumes a modulating position, in which it controls the pressure in the control chamber 47, to sufficiently throttle fluid flow from the outlet chambers 26 and 27 to maintain a constant pressure differential across metering slots 37 and 39. While controlling a negative load the free floating piston 62 is maintained in contact with the pilot valve spool 61 by the pressure differential developed across it.

The control space 64 is connected through the logic system of check valves 86 and 98 either with positive load sensing port 28 or 29, during control of positive load, or with outlet chamber 26 or 27 during control of negative load. This specific feature, together with the action of the free floating piston 62, permits the use of the same pilot valve section 12 in control of both positive and negative loads.

During control of positive loads the positive load pressure signals from the valve section 10 and the control circuit 91 are transmitted through the logic system of check valves 89 and 92 to the pump flow control 15.

The logic system of check valves 94 and 101, in a well known manner, transmits the fluid energy to the pilot valve section 12 either from the pump 14 or from the negative load through the outlet chamber 48. This feature permits control of negative load W with the system pump 14 inactive.

During control of negative load, with the fluid being throttled by negative load throttling slots 57, throttling edges 56 cut off communication between the inlet chamber 45 and the supply chamber 46. Under those conditions the make-up fluid to the load chamber 24 or 25 is supplied through check valve 40 or 41 from the system reservoir 16, increasing the capacity of the pump 14 to perform useful work. The control space 64 is connected through the leakage flow section 76 with the system reservoir 16. Leakage flow section 76 may be in the form of a simple uncompensated orifice, or may be in the form of a flow control valve, which permits constant flow from control space 64 irrespective of the control pressure level in the control space 64.

Referring now to FIG. 2, the digital actuator 78 may be in the form of a stepper motor 78, which will translate electrical pulses into discrete mechanical rotational movements of the shaft 106. With such a device, for each electrical impulse, the shaft 106 will rotate through a specific arc of rotation say, for example 15°. The direction of rotation of the stepper motor is determined by the signal supplied to the stepper motor driver, not shown. Each angular step of the shaft 106 will be transmitted through the coupling 107 to the rotary shaft 108, provided with threaded extension 113. Since the threaded extension 113 engages the internal thread of input sleeve 114, each angular step of the rotary shaft 108 will correspond to a certain specific linear displacement of the input sleeve 114, the magnitude of the linear step being established by the characteristics of the thread. Therefore the number of angular steps of the digital actuator 78 will be translated by the action of the rotary threaded shaft 108 into an equal number of linear steps, transmitted to input sleeve 114. The input sleeve 114 is part of the hydraulic force amplifier 79, which transmits those linear steps at higher force level to the valve spool 19, see FIG. 1. A very small stepper motor 78, in a manner as previously described, controls the position of the input sleeve 114, each angular step of the stepper motor 78 resulting in a proportional linear step of the input sleeve 114. The input sleeve 114 is provided with a slotted end 117, locating a pin 118, which engages through slot 119 the servo link 120. The servo link 120 is pivoted by slot 124 on pin 125, located on the extension 126 of the cylindrical end 127, which is part of the actuator 128. The servo link 120 is also pivoted for angular rotation by pin 121 secured to slotted end 122 of the pilot valve 123.

Assume that the input sleeve 114, with its pin 118, will be moved a number of linear steps from right to left. Since the pin 125 remains stationary, the servo link 120 will rotate in a counterclockwise direction moving through the pin 121, the pilot valve 123 from right to left. This motion, through displacement of land 136, will connect annular space 143 with annular space 141, thus automatically connecting, through passage 143, the oil under system pressure with space 132. At the same time through equal displacement of land 137, the annular space 142 will be connected to annular space 140, which is connected through passages 144 and 146 with the system reservoir, thus effectively connecting through passage **142*a* the space 131 with the system reservoir. The pressure differential, developed between spaces 132 and 131, will move the piston 129 and the actuator 128 from right to left, subjecting the servo link 120, through pin 125, to clockwise rotation and therefore moving the pilot valve 123 through pin 121 from left to right, to the position as shown, with the lands 136 and 137 effectively isolating spaces 131 and 132. Therefore each linear step of the input sleeve 114 from right to left, through the above described action of the servo link 120 and the pilot valve 123, will result in a proportional linear step of the actuator 128, the linear step of the actuator 128 being longer than the linear step of input sleeve 114 by the ratio of distances between pin 125 and pin 118 and pin 118 and pin 121. Therefore, small linear steps of the input sleeve 114 can be amplified into proportional larger linear steps of the actuator 128, as dictated by the geometry of the servo link 120**.

Movement of the input sleeve 114 from left to right will rotate the servo link 120 around the pin 125 in a clockwise direction, moving the pilot valve 123 from left to right. The displacement of pilot valve 123 will connect space 131 with oil at system pressure and space 132 with system reservoir. The pressure differential between spaces 131 and 132 will move the piston 129 and the actuator 128 from left to right, rotating the servo link 120 around pin 118 in a counterclockwise direction and bringing the pilot valve 123 to the position as shown in FIG. 2. Therefore, each linear step of the input sleeve 114 from left to right will result in a proportional larger linear step from left to right of the actuator 128, due to the control action of the servo link 120 and pilot valve 123, the motion of the actuator 128 and pin 125 providing mechanical feedback.

Since a very small force is required to displace the pilot valve 123, a very small digital actuator 78, with a very high response, can be used. The rotary to linear motion converting mechanism of a screw is characterized by very high mechanical advantage and very large reduction in the length of the linear steps. Through the action of the servo link 120 of FIG. 2 those small digital linear input steps can be amplified by the geometry of the servo link 120 of FIG. 2 into much larger digital steps of the actuator 128. Therefore the arrangement of FIG. 2 acts not only as a force amplifier, but also amplifies the digital linear input into a proportional larger digital output of the actuator 128. Therefore position of the actuator 128 can be effectively controlled in response to the digital input signal through the arrangement of FIG. 2.

In a well known manner a pilot valve, similar to the pilot valve 123, can be located in the centrally located bore of the cylindrical end 127, providing a follow-up servo arrangement, With this type of servo the displacement of the input sleeve 114, directly connected to the pilot valve, will be exactly duplicated by the displacement of the actuator 128. Since with this type of arrangement no amplification of the input signal takes place, the pilot valve must be displaced through the full control stroke of the actuator 128, thus resulting in a much slower acting mechanism with a much slower response.

The coupling 107 is provided with gear section 110, which preferably has the same number of teeth as the number of angular steps of the digital actuator 78, required for one complete revolution. The pulse pick-up 111, well known in the art, is positioned in respect to the periphery of the gear section 110, to obtain a proper working gap. The digital actuator 78, in the form of a stepper motor, is capable of high angular accelerations and decelerations, permitting a traverse of the individual teeth of the gear section 110 at comparatively high velocity past the pulse pick-up 111. This rapid traverse of each gear tooth, equivalent to each angular step of the stepper motor, will generate, in a well known manner, an electrical pulse in the pulse pick-up 111, which can be used to establish if any specific angular step of the digital actuator 78, in the form of a stepper motor, did take place.

Referring now to FIG. 3, the digital actuator 78, in the form of a stepper motor, is shown in greater detail. The stator 156 is usually composed of two coils. Two stator caps formed around each of those coils, with pole pairs mechanically displaced by half a pole pitch become alternately energized north and south magnetic poles. Between the two stator coil pairs the displacement is a quarter of a pole pitch. The permanent magnet rotor 159 is magnetized with the same number of pole pairs as contained by one stator coil section. Interaction between the rotor 159 and the stator 156 causes the rotor 159 to move one quarter of a pole pitch per winding polarity change. Depending on construction, a typical stepper motor will move either 48 steps per revolution or 7.5° per step, or will move 24 steps per revolution or 15° per step. The rotor 159 with its shaft 106 is journalled in the bearings 157 and 158. The electrical power to the stator 156 is supplied from the driver 81, which usually takes the form of a logic chip. The driver 81 receives a low power pulse signal 165, which determines the number of angular steps of the shaft 106 and also receives a steady voltage signal 166, the level of this voltage determining the direction of rotation of the shaft 106. The logic chip is essentially a solid state switching device, which responds to a low energy switching signal and connects, at an instant, comparatively high input current to the stepper motor 153. Therefore the logic chip acts as a form of amplifying device. The rotary motion, or rotary digital steps, of the shaft 106 are translated into linear steps by the rotary to linear motion translating mechanism 154, which was described in detail, when referring to FIG. 2. The linear digital steps of the drive are transmitted directly to the valve spool 19 by the threaded end 113. One end 160 of the shaft 106 protrudes outside of the digital actuator 78 and is provided with the hand wheel 161, fastened to the shaft end 160 by the lock screw 162. With the stepper motor inactive, by manually turning the hand wheel 161, while utilizing the existing rotary to linear translating mechanism the position of the valve spool 19 can be adjusted. This feature is very important in case of control failure, or when adjustment in the position of the load has to be made with the electrical system inactive. The end of the shaft 160 and the hand wheel 161 are protected by the removable guard 163, which can be either removed or installed on the stepper motor.

Referring now to FIG. 4, the digital actuator 78, in the form of a stepper motor, is provided with an enlarged shaft 167, secured to the rotor 159, the shaft and rotor being journalled in bearings, not shown. The enlarged shaft 167 is internally threaded to receive threaded shaft 168, which is threaded into valve spool 19, and locked in position by the lock nut 169. The cylindrical end of the valve spool 19 is provided with slot 170, which is engaged by the antirotational pin 171. Rotation of the rotor 159 and the enlarged shaft 167, in a well known manner, will transmit an axial movement to the threaded shaft 168. The arrangement of FIG. 4 performs in an identical way as the arrangement of FIG. 3, but it is simpler, since it requires one less bearing.

Referring now to FIG. 5, the digital proportional valve using the proportional valve of FIG. 1 is shown. The digital drive of FIGS. 1 and 2 of the valve spool 19 of FIG. 1 is shown in detail together with the lost motion mechanism 80. The force and linear displacement of the actuator 128, of the hydraulic force amplifier 70, is transmitted to the valve spool 19 through the lost motion mechanism 80, which is provided to permit the manual displacement of the valve spool 19, using the manual input lever 77, see FIG. 1, through its entire control stroke, irrespective of the position of the actuator 128, position of which is controlled by the digital input drive 78. In this arrangement the automatic proportional remotely positioning function, say in position of a load, can be completely overriden at any instant by direct manual input from the operator at the control valve, through manual input lever 77 of FIG. 1. The linear control input from the actuator 128 can be fully transmitted to valve spool 19 as long as the total effort to move the valve spool 19 does not exceed the preload in the spring 179. In the position as shown in FIG. 5, the spring 179 maintains the reaction member 177 against stop 174 and the reaction member 178 against the retaining ring 176, while also maintaining the reaction member 177 against the retaining ring 182 and reaction member 178 against the retainer ring 181. Therefore any force transmitted by the actuator 128, lower than the preload of spring 179, will be automatically transmitted from right to left through retainer ring 181, the reaction member 178, the spring 179, reaction member 177 to the stop 174 and therefore to the valve spool 19. Conversely any force transmitted to the actuator 128, lower than the preload of spring 179, will be automatically transmitted from left to right through the retaining ring 182, the reaction member 177, the spring 179, the reaction member 178 and the retaining ring 176 to the sleeve 173 and therefore to the valve spool 19. Therefore angular digital steps of the shaft of the stepper motor 153, in a clockwise or counterclockwise direction, will be transmitted as linear digital steps through the hydraulic force amplifier 79, moving the valve spool 19 from right to left or left to right, as long as the actuating force, transmitted through the lost motion mechanism 80, does not exceed the preload in the spring 179.

Assume that with the digital actuator 78 inactive the valve spool 19 must be moved manually to perform a function. Since as is well known in the art, the conventional thread of threaded extension 113, engaging the input sleeve 114, is mechanically irreversible, the position of the input sleeve 114 will remain unchanged.

Movement of the valve spool 19 from left to right will then, through the reaction member 177, compress the spring 179, with the retaining ring 182 leaving the reaction member 177, while the reaction member 178 is maintained stationary by the retainer ring 181, the reaction force of the compressed spring 179 being transmitted to the hydraulic force amplifier 79 or to the input sleeve 114. The distance between the reaction members 177 and 178 is so selected, that it is greater than the maximum stroke of the valve spool 19. In this way, irrespective of the position of the actuator 128, the valve spool 19 can be manually displaced from left to right through its entire control stroke.

With the digital actuator 78 inactive and the valve spool manually displaced from right to left, the manual actuating force is transmitted through the sleeve 173, retaining ring 176 and reaction member 178, compressing the spring 179, while the reaction member 177 is maintained stationary by the retaining ring 182 of the actuator 128, the reaction force of the spring compression being transmitted to the hydraulic force amplifier 79 or to the input sleeve 114. Since as previously described the distance between the reaction members 177 and 178 is greater than the maximum control stroke of the valve spool 19, the valve spool 19 can be actuated from right to left through its entire control stroke, irrespective of the position of the actuator 128. Therefore with the digital actuator 78 inactive, the valve spool 19 can be manually displaced through its entire control stroke in either direction through the lost motion mechanism 80, permitting direct manual control of the flow control valve of FIG. 1, irrespective of the position of the input sleeve 114 and therefore irrespective of the actuating position of the digital actuator 78 and the hydraulic force amplifier 79.

A number of pulses, proportional to the displacement of the manual lever 190 from its neutral position, is transmitted from manually operated pulse generator 188 to the signal storage device 15*c*, which also receives a pulse feedback from transducer 82 and pulse pick-up 111 through line 82*a*. The signal storage device 15*c* is well known in the art and automatically compares the number of pulses transmitted from the manually operated pulse generator 188 with the number of pulses transmitted by the pulse pick-up 111 and resulting from the steps of the stepper motor and transmits an error signal through line 81*a* to the solid state switching device 81. A voltage signal, transmitted from the reverse switch 195 through line 207 to the solid state switch 81, determines the direction of rotation of the stepper motor 153. When depressing the on-off button 199 the switch 196 is actuated through the connecting mechanism 198, shown by dotted line, actuating the pin 197. With switch 196 actuated the electrical power is supplied to the pulse pick-up 187, which is then capable of transmitting electrical pulse signals to the solid state switching device 81.

Rotation of the manual lever 190 in either direction in respect to the quadrant 201, engages through extension 192 and pin 193 or 194 the gear sector 189 journalled around pivot of pin 191. Rotation of gear sector 189 causes rotation of spur gears 202, 203 and 204, in a well known manner increasing the angular displacement of the pulse disc 205 in respect to rotation of manual lever 190. The angular displacement of disc 205 is so selected that full displacement of the manual lever 190 in either direction from its neutral position will result in a number of teeth 206 being traversed past the pulse pick-up 187, equal to the number of linear steps of the input sleeve 114 required for full control stroke of the valve spool 19. When rotating the manual lever 190 in a clockwise direction and when depressing the on-off button 199 a number of electrical pulses is transmitted to the solid state switching device 81, each pulse triggering a connection of the stepper motor 153 with the source of electrical energy and resulting in a limited rotation of the stepper motor 153 in one specific direction. The reverse switch 195 is then in an unactuated position.

With the on-off button 199 depressed and switch 196 actuated an anticlockwise rotation of the manual lever 190 will not only transmit a number of pulses to the solid state switching device 81, but also, by actuating the reverse switch 195 will supply through line 207 to the solid state switch 81 a direction signal, reversing direction of rotation of the stepper motor 153. The reverse signal is in the form of a steady voltage, the level of which determines if the direction of rotation is to be changed.

Angular displacement of the manual lever without depressing the on-off button 199 will not generate any electrical pulses and the manual lever 190 can be centered, synchronizing its position with the position of the valve spool 19.

A magnetic pick-up of the pulse pick-up 187 in its conventional form will not respond to the traverse of the slow moving teeth 206, of the pulse disc 205. Such a pick-up should be substantially modified, when used in this application, should generate an essentially square wave and is used only to show the basic concept. On the other hand the same magnetic pick-up, when used with a stepper motor, can be of a more conventional form, since even when transmitting a single step, due to very high accelerations, the velocity of the tooth past the pulse pick-up 111 will be sufficiently high to generate a pulse signal. There are a number of proximity censors through which pulses can be generated at very low frequencies and which can be used in pulse pick-up 187.

Referring now to FIG. 6, the digital actuator 78, composed of stepper motor and lead screw combination, directly actuates the valve spool 19. This digital valve spool drive is identical to that of FIG. 3 and was already described in detail, when referring to FIG. 3. To directly actuate the valve spool 19 the power levels, developed in the digital actuator 78, are very much higher, since the hydraulic force amplifying stage is not provided. Therefore the solid state switch, or the driver 81, which usually takes the form of a logic chip, must deal with much higher current levels. The logic chip is essentially a solid state switching device, which responds to a low energy pulse or switching signal and connects at an instant comparatively high input current to the stepper motor, therefore acting as a form of amplifying device. The manually operated pulse generator is very similar to that of FIG. 5 and uses the same manual lever and gear sector combination, the same gear train and the same electrical switches. However, the gear train of the manually operated pulse generator 188 drives through a set of bevel gears disc 213, which is interposed between the source of light transmitting assembly, based on the principle of fiber optics and composed of two transparent fittings 217 and 219 and glass fiber strands 218. The segments 214 and adjacent slots sequentially interrupt and allow to pass the light beam between the source of light 216 and the transparent fitting 217, generating essentially a square type wave. The segements 214 can be substituted by uniformly spaced perforations or holes. With the electrical switch 196 activated and manual lever 190 rotated in a clockwise direction, a series of light pulses will be transmitted through the fiber optics to the transparent fitting 219, which is positioned in front of the photo-electric cell or light sensing diode assembly 220, well known in the art. Such an assembly in a well known manner, will change the light pulses into electrical pulses, supplying through line 81*a* the solid state switch or driver 81 with the digital pulse signal, each pulse being translated, in a manner as previously described, into a specific angular step of the stepper motor. When rotating the manual lever 190 in a counterclockwise direction, with the on-off button 199 depressed, not only the pulse signals are transmitted to the solid state switch 81, but also the reverse direction control circuit is activated. Actuation of the reverse switch 195 connects electrical power to source of light 223 and the light beam is transmitted through the fiber optics assembly, composed of two transparent fittings 224 and 226 and the glass fiber strands 225, to the photo-electric cell or light sensing diode 227. In a well known manner the photo-electric cell 227, in the presence of the light beam, will transmit an electrical steady voltage signal through line 228 to the solid state switch 81. In this way clockwise rotation of the manual lever 190 will proportionally control the position of the valve spool 19 in one direction, each position of the manual lever 190 corresponding to a specific position of the valve spool 19, while counterclockwise rotation of the manual lever 190 will control the position of the valve spool 19 in the opposite direction. As is well known in the art light pulses can be transmitted through fiber optics for some considerable distance and the cable made out of strands of glass fibers does not conduct electric current. This property is very useful in special applications, when controlling a platform in the vicinity of high tension wires, or when remotely controlling a machine in a potentially explosive environment, for example a coal mine.

When actuating a valve spool at high force levels the stepper motors not only become large, but their response characteristics are greatly reduced. In the flow control valve of FIG. 1 the positive and negative load compensators control the pressure differential across the metering orifices of the valve spool. In this way the flow forces, acting on the valve spool, which at high pressure drops in high pressure systems can reach hundreds of pounds, are limited to a comparatively low level. Therefore the arrangement of FIG. 1 permits direct control of the valve spool by a stepper motor, while still providing acceptable response characteristics.

Referring to FIG. 8, the valve spool 19 is directly actuated by the digitial drive of FIG. 4. The manually operated pulse generator 188 of FIG. 8 is identical to the pulse generator of FIG. 7, with one exception. The disc 229 of FIG. 8 is provided with current conducting discs 230, evenly spaced in the vicinity of its periphery, instead of being provided with the segments 214 of FIG. 7. With switch 196 actuated an electric current is supplied to the contact 231, which is positioned opposite contact 232, both of those contacts slidably engaging the disc 229. The radio transmitter 233, operating at X frequency, is connected to contact 232, the electric current being permitted to flow between both contacts through the current conducting disc 230. Rotation of the disc 229 will sequentially connect and disconnect the radio transmitter 233 from the electrical current, the radio transmitter 233 emitting pulses of radio waves at X frequency. The radio receiver assembly 234 is tuned to the X frequency and generates, in a well known manner, using well known components, an electrical control signal while receiving radio waves at X frequency. In this way rotation of the manual lever 190 and corresponding rotation of the disc 229 will generate radio wave pulses by transmitter 233, which will be converted into equivalent electrical pulses by the receiver 234 and transmitted through the solid state switch 81 to the stepper motor, advancing the stepper motor in a series of angular steps, equal in number to a number of control pulses, in one direction. Counterclockwise rotation of the manual lever 190 will activate the reverse switch 195, which will supply the electric current to the radio wave transmitter 237, operating at Y frequency. The radio wave receiver 238 is tuned to the Y frequency and, in a well known manner, will generate an electrical control signal, as long as the transmitter 237 is transmitting. This electrical control signal is transmitted from the receiver 238 through line 228 to the solid state switch 81, reversing the direction of rotation of the stepper motor. Therefore the end performance of the digital actuator of FIG. 8 is identical to that of the digital actuator of FIG. 7, with each position of the manual lever 190 corresponding exactly to a specific position of the valve spool 19, each side of its neutral position.

As is well known in the art various modulation and subcarrier signal multiplexing methods, employing a single transmitter, can be used to accomplish the same pulse and direction signal generation and transmission.

It is always feasible that, for example, due to contamination, the resistance to motion of the valve spool 19 will exceed the force generating capacity of the stepper motor. Under those conditions the position of the manual lever 190 will no longer be exactly equivalent to the position of the valve spool 19. This sudden resistance of valve spool 19 can be cleared by actuation of the valve spool 19 by the hand wheel 161, acting through the mechanical advantage of the lead screw mechanism. Then the exact relationship between position of the manual lever 190 and the valve spool 19 can be reestablished by bringing the valve spool 19 through the action of hand wheel 161 into its neutral position and positioning the manual lever 190 without actuation of the on-off button 199 to its zero position as shown in FIG. 8.

Assume that valve spool 19 is freed by the action of the hand wheel 161, while the control circuit is active. Then previously described storage device 15*c* provided with the signals transmitted from the digital transducer 82, will automatically bring the valve spool 19 into its proper position, as dictated by the position of the manual lever 190.

The hand wheels 161 of FIG. 6 and 161 of FIG. 8 perform an additional safety function. They permit, through the existing force amplifying lead screw mechanism of the digital drive, to move the valve spool 19 with either electrical system inactive, or system pump inactive, permitting for example lowering of a load.

The arrangement of FIG. 8 shows a proportional valve, proportionally operated from a remote location without any physical link-up in the form of electrical or optical cables between the signal generator and the proportional valve. With the flow control valve of FIG. 1 operated by the control system of FIG. 8 not only the position of the valve spool 19, each side of center, will be exactly equivalent to the position of the control lever, each side of its neutral position, but each position of the valve spool 19 will also correspond to an exact flow through the valve, irrespective of the magnitude of the positive or negative load being controlled. This control characteristic greatly simplifies the remote control of a load. There are many applications for such valves, especially in environments hazardous to human life or health, or when the work has to be performed in an environment of high physical discomfort.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the source of the invention as defined in the claims.

What is claimed is:

1. A valve assembly having valve means operable to control by throttling fluid flow to and from a fluid motor subjected to an opposing or aiding load, linear step output means operable to actuate said valve means in discrete steps equal in number to a number of pulses in an intermittent pulse type control signal, intermittent pulse type control signal generating means having manual input control means operable to generate a number of pulses proportional to a manual input signal the number of said pulses being independent of the time taken in generation of said manual control signal, and intermittent pulse type control signal transmitting means interconnecting said intermittent pulse type control signal generating means and said linear step output means for actuating said valve means through a distance proportional to the magnitude of said manual input signal.

2. A valve assembly as set forth in claim 1 wherein said linear step output means includes a stepper motor means interconnected to a rotary to linear motion translating means.

3. A valve assembly as set forth in claim 1 wherein said linear step output means includes fluid power force amplifying means.

4. A valve assembly as set forth in claim 3 wherein said fluid power force amplifying means includes linear step distance amplifying means.

5. A valve assembly as set forth in claim 4 wherein said linear step distance amplifying means includes servo beam means.

6. A valve assembly as set forth in claim 1 wherein limiting force transmitting lost motion means is interposed between said linear step output means and said valve means.

7. A valve assembly as set forth in claim 1 wherein manual control means is interconnected to said valve means.

8. A valve assembly as set forth in claim 1 wherein said intermittent pulse type control signal transmitting means has electrical pulse transmitting means.

9. A valve assembly as set forth in claim 1 wherein said intermittent pulse type control signal transmitting means includes first transducer means operable to convert an electrical signal into a light signal, transmitting means operable to transmit said light signal, a second transducer means operable to convert a light signal into an electrical signal.

10. A valve assembly as set forth in claim 1 wherein said intermittent pulse type control signal transmitting means includes first transducer means operable to convert an electrical signal into a ratio wave signal and second transducer means operable to convert said ratio wave signal into an electrical signal.

11. A valve assembly as set forth in claim 1 wherein a switching logic means is interposed between said intermittent pulse type control signal generating means and said linear step output means.

12. A valve assembly as set forth in claim 1 wherein said linear step output means includes adjusting means operable to synchronize said linear step output means with a pulse type signal generated by said intermittent pulse type control signal generating means.

13. A valve assembly as set forth in claim 1 wherein a closed loop digital synchronizing means is interposed between said control signal generating means and said linear step output means.

14. A valve assembly as set forth in claim 13 wherein said closed loop digital synchronizing means has fiber optics signal transmitting means.

15. A valve assembly as set forth in claim 13 wherein said closed loop digital synchronizing means has radio wave signal transmitting means.

16. A valve assembly as set forth in claim 1 wherein said manual input control means has manual synchronizing means operable to synchronize the position of said manual input control means with the output of said linear step output means.

17. A valve assembly having valve means operable to control by throttling fluid flow to and from a fluid motor subjected to an opposing or an aiding load pressure, fluid operated force amplifying means operably connected to said valve means, linear step output means operable through said force amplifying means to actuate said valve means in discrete linear steps in response to an intermittent pulse type control signal, intermittent pulse type control signal generating means having manual input control means operable to generate a number of pulses proportional to a manual input signal to produce intermittent pulse type control signal the number of said pulses being independent of the time taken in generation of said intermittent pulse type control signal, and intermittent pulse type signal transmitting means interconnecting said intermittent pulse type control signal generating means and said linear step output means for actuating said valve means through a distance proportional to the magnitude of said manual input signal.

18. A valve assembly as set forth in claim 17 wherein said linear step output means includes a stepper motor means interconnected to a rotary to linear motion translating means.

19. A valve assembly as set forth in claim 17 wherein limiting force translating lost motion means is interposed between said force amplifying means and said valve means.

20. A valve assembly as set forth in claim 17 wherein manual control means is interconnected to said valve means.

21. A valve assembly as set forth in claim 17 wherein a switching logic means is interposed between said intermittent pulse type control signal generating means and said linear step output means.

22. A valve assembly as set forth in claim 17 wherein said pressure fluid operated force amplifying means includes positioning means of said valve means and pilot valve means operable to control the position of said positioning means.

23. A valve assembly as set forth in claim 22 wherein a servo link means is interposed between said pilot valve means and said linear step output means.

24. A valve assembly as set forth in claim 17 wherein said intermittent pulse type control signal generating means includes electrical pulse generating means.

25. A valve assembly as set forth in claim 17 wherein said intermittent pulse type control signal generating means includes light pulse generating means.

26. A valve assembly as set forth in claim 17 wherein said intermittent pulse type control signal generating means includes radio wave pulse generating means.

27. A valve assembly as set forth in claim 17 wherein said intermittent pulse type control signal transmitting means has electrical pulse transmitting means.

28. A valve assembly as set forth in claim 17 wherein said intermittent pulse type control signal transmitting means includes first transducer means operable to convert an electrical signal into a light signal, transmitting means operable to transmit said light signal, and second transducer means operable to convert a light signal into an electrical signal.

29. A valve assembly as set forth in claim 28 wherein said first transduer means is interconnected to said intermittent pulse type control signal generating means.

30. A valve assembly as set forth in claim 28 wherein said second transducer means is functionally interconnected to said linear step output means.

31. A valve assembly as set forth in claim 28 wherein said transmitting means includes fiber optic light transmitting means.

32. A valve assembly as set forth in claim 17 wherein said intermittent pulse type control signal transmitting means includes first transducer means operable to convert an electrical signal into a radio wave signal and second transducer means operable to convert said radio wave signal into an electrical signal.

33. A valve assembly as set forth in claim 32 wherein said first transducer means is interconnected to said intermittent pulse type control signal generating means.

34. A valve assembly as set forth in claim 32 wherein said second transducer means is functionally interconnected to said linear step output means.

35. A valve assembly as set forth in claim 34 wherein a switching logic means is interposed between said second transducer means and said linear step output means.

36. A valve assembly as set forth in claim 17 wherein said manual input control means includes manual lever means functionally interconnected to said intermittent pulse type control signal generating means and to reverse rotation signal generating means.

37. A valve assembly as set forth in claim 36 wherein first manually operated switching means is interconnected to said intermittent pulse type control signal generating means.

38. A valve assembly as set forth in claim 36 wherein a second reverse switching means is interposed between said manual lever means and said reverse rotation signal generating means.

39. A valve assembly as set forth in claim 36 wherein switching logic means is interposed between said linear step output means and said reverse rotation signal generating means.

40. A valve assembly as set forth in claim 17, wherein said manual input control means has synchronizing means operable to synchronize said manual input control means with said linear step output means.

41. A valve assembly as set forth in claim 17, wherein said manual input control means includes reverse signal generating means.

42. A valve assembly as set forth in claim 17, wherein said manual input control means includes manual lever means operable to generate a number of pulses proportional to a manual input signal when displaced in forward and reverse directions and also operable to engage a reverse signal generating means when displaced in said reverse direction.

43. A valve assembly as set forth in claim 17, wherein said manual input control means includes manual lever means and activating means of said intermittent pulse type control signal generating means.

44. A valve assembly having valve means operable to control by throttling fluid flow to and from a fluid motor subjected to an opposing or aiding load, first fluid throttling means positioned adjacent to said valve means having means operable to control pressure differential across said valve means during control of an opposing load, second fluid throttling means positioned adjacent to said valve means having means operable to control pressure differential across said valve means during control of an aiding load, linear step output means operable to actuate said valve means in discrete steps equal in number to a number of pulses in an intermittent pulse type control signal said linear step output means having control means responsive to said intermittent pulse type control signal, intermittent pulse type control signal generating means having manual input control means operable to generate a number of pulses proportional to a manual input signal to produce intermittent pulse type control signal the number of said pulses being independent of the time taken in generation of said intermittent pulse type control signal, and intermittent pulse type control signal transmitting means interconnecting said intermittent pulse type control signal generating means and said control means for varying fluid flow to and from said fluid motor proportionally to the magnitude of said manual input signal irrespective of the magnitude of said aiding or said opposing load.

45. A valve assembly as set forth in claim 44 wherein said linear step output means includes a stepper motor means interconnected to a rotary to linear motion translating means.

46. A valve assembly as set forth in claim 44 wherein said linear step ouput means includes fluid power force amplifying means.

47. A valve assembly as set forth in claim 44 wherein limiting force transmitting lost motion means is interposed between said linear step output means and said valve means.

48. A valve assembly as set forth in claim 44 wherein manual control means is interconnected to said valve means.

49. A valve assembly as set forth in claim 44 wherein switching logic means is interposed between said intermittent pulse type control signal generating means and said linear step output means.

50. A valve assembly having valve means operable to control by throttling fluid flow to and from a fluid motor subjected to an opposing or aiding load, first fluid throttling means positioned adjacent to said valve means having means operable to control pressure differential across said valve means during control of an opposing load, second fluid throttling means positioned adjacent to said valve means having means operable to control pressure differential across said valve means during control of an aiding load, pressure fluid operated force amplifying means operably connected to said valve means, and linear step output means operable through said force amplifying means to actuate said valve means in discrete linear steps in response to an intermittent pulse type control signal, intermittent pulse type control signal generating means having manual input control means operable to generate a number of pulses proportional to a manual input signal to produce intermittent pulse type control signal the number of said pulses being independent of the time taken in generation of said intermittent pulse type control signal, and intermittent pulse type signal transmitting means interconnecting said intermittent pulse type control signal generating means and said linear step output means for varying fluid flow to and from said fluid motor proportionally to the magnitude of said manual input signal irrespective of the magnitude of said aiding or said opposing load.

51. A valve assembly having valve means operable to control by throttling fluid flow to and from a fluid motor subjected to an opposing or aiding load, first fluid throttling means positioned adjacent to said valve means, second fluid throttling means positioned adjacent to said valve means, pilot valve means operable through said first fluid throttling means to control pressure differential across said valve means during control of an opposing load and also operable through said second fluid throttling means to control pressure differential across said valve means during control of an aiding load, linear step output means operable to actuate said valve means in discrete steps equal in number to a number of pulses in intermittent pulse type control signal said linear step output means having control means responsive to said intermittent pulse type control signal, intermittent pulse type control signal generating means having manual input control means operable to generate a number of pulses proportional to a manual input signal to produce intermittent pulse type control signal the number of said pulses being independent of the time taken in generation of said intermittent pulse type control signal, and pulse type control signal transmitting means interconnecting said intermittent pulse type control signal generating means and said control means for varying fluid flow to and from said fluid motor proportionally to the magnitude of said manual input signal irrespective of the magnitude of said aiding or said opposing load.

52. A valve assembly having valve means operable to control by throttling fluid flow to and from a fluid motor subjected to an opposing or aiding load, first fluid throttling means positioned adjacent to said valve means, second fluid throttling means positioned adjacent to said valve means, pilot valve means operable through said first fluid throttling means to control pressure differential across said valve means during control of an opposing load and also operable through said second fluid throttling means to control pressure differential across said valve means during control of an aiding load, pressure fluid operated force amplifying means operably connected to said valve means, and linear step output means operable through said force amplifying means to actuate said valve means in discrete linear steps in response to an intermittent pulse type control signal, intermittent pulse type control signal generating means having manual input control means operable to generate a number of pulses proportional to a manual input signal to produce an intermittent pulse type control signal the number of said pulses being independent of the time taken in generation of said intermittent pulse type control signal, and pulse type signal transmitting means interconnecting said intermittent pulse type control signal generating means and said linear step output means for varying fluid flow to and from said fluid motor proportionally to the magnitude of said manual input signal irrespective of the magnitude of said aiding or said opposing load.

53. A valve assembly having valve means operable to control by throttling fluid flow to and from a fluid motor subjected to an opposing or an aiding load, linear step output means operable to actuate said valve means in discrete linear steps equal in number to a number of pulses in an intermittent pulse type control signal, intermittent pulse type control signal generating means having manual input control means operable to generate a number of pulses proportional to a manual input signal, intermittent pulse type control signal transmitting means interconnecting said intermittent pulse type control signal generating means and said linear step output means for actuating said valve means through a distance proportional to the magnitude of said manual input signal, and limiting force transmitting lost motion means interposed between said linear step output means and said valve means.

54. A valve assembly having valve means operable to control by throttling fluid flow to and from a fluid motor subjected to an opposing or an aiding load, linear step output means operable to actuate said valve means in discrete steps equal in number to a number of pulses in an intermittent pulse type control signal, intermittent pulse type control signal generating means having manual input control means operable to generate a number of pulses proportional to a manual input signal the number of said pulses being independent of the time taken in generation of said manual control signal, intermittent pulse type control signal transmitting means interconnecting said intermittent pulse type control signal generating means and said linear step output means, and synchronizing means in said manual input control means operable to synchronize said manual input control means with said linear step output means.

55. A valve assembly having valve means operable to control by throttling fluid flow to and from a fluid motor subjected to an opposing or an aiding load pressure, fluid operated force amplifying means operably connected to said valve means, linear step output means operable through said force amplifying means to actuate said valve means in discrete linear steps in response to an intermittent pulse type control signal, intermittent pulse type control signal generating means having manual input control means operable to generate a number of pulses proportional to a manual input signal to produce intermittent pulse type control signal, intermittent pulse type signal transmitting means interconnecting said intermittent pulse type control signal generating means and said linear step output means for actuating said valve means through a distance proportional to the magnitude of said manual input signal, and synchronizing means in said manual input control means operable to synchronize said manual input control means with said linear step output means.

56. A valve assembly having valve means operable to control by throttling fluid flow to and from a fluid motor subjected to an opposing or an aiding load pressure, fluid operated force amplifying means operably connected to said valve means, linear step output means operable through said force amplifying means to actuate said valve means in discrete linear steps in response to an intermittent pulse type control signal, intermittent pulse type control signal generating means having manual input control means operable to generate a number of pulses proportional to a manual input signal to produce intermittent pulse type control signal, intermittent pulse type signal transmitting means interconnecting said intermittent pulse type control signal generating means and said linear step output means for actuating said valve means through a distance proportional to the magnitude of said manual input signal, and limiting force translating lost motion means interposed between said force amplifying means and said valve means.

57. A valve assembly having valve means operable to control by throttling fluid flow to and from a fluid motor subjected to an opposing or an aiding load pressure, fluid operated force amplifying means operably connected to said valve means, linear step output means operable through said force amplifying means to actuate said valve means in discrete linear steps in response to an intermittent pulse type control signal, intermittent pulse type control signal generating means having manual input control means operable to generate a number of pulses proportional to a manual input signal to produce intermittent pulse type control signal, intermittent pulse type signal transmitting means interconnecting said intermittent pulse type control signal generating means and said linear step output means for actuating said valve means through a distance proportional to the magnitude of said manual input signal, positioning means of said valve means and pilot valve means operable to control the position of said positioning means, and servo link means interposed between said pilot valve means and said linear step output means.

58. A valve assembly having valve means operable to control by throttling fluid flow to and from a fluid motor subjected to an opposing or aiding load, first fluid throttling means positioned adjacent to said valve means having means operable to control pressure differential across said valve means during control of an opposing load, second fluid throttling means positioned adjacent to said valve means having means operable to control pressure differential across said valve means during control of an aiding load, linear step output means operable to actuate said valve means in discrete steps equal in number to a number of pulses in an intermittent pulse type control signal said linear step output means having control means responsive to said intermittent pulse type control signal, intermittent pulse type control signal generating means having manual input control means operable to generate a number of pulses proportional to a manual input signal to produce intermittent pulse type control signal and intermittent pulse type control signal transmitting means interconnecting said intermittent pulse type control signal generating means and said control means, and limited force transmitting lost motion means interposed between said linear step output means and said valve means whereby fluid flow to and from said fluid motor can be varied proportionally to the magnitude of said manual input signal irrespective of the magnitude of said aiding or said opposing load.

* * * * *